US008439028B2

(12) United States Patent
Haberkamm et al.

(10) Patent No.: US 8,439,028 B2
(45) Date of Patent: May 14, 2013

(54) COOKING APPLIANCE WITH AN OVEN RACK

(75) Inventors: Ramona Haberkamm, Traunreut (DE); Amanda Mehring, New Bern, NC (US); Kevin W. Sherbert, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 1259 days.

(21) Appl. No.: 11/703,557

(22) Filed: Feb. 6, 2007

(65) Prior Publication Data

US 2008/0184987 A1 Aug. 7, 2008

(51) Int. Cl.
*F24C 15/16* (2006.01)

(52) U.S. Cl.
USPC ..... 126/332; 126/337 R; 126/339

(58) Field of Classification Search ..... 126/332; 29/460; 211/181.1; 312/410, 408, 334.4
See application file for complete search history.

(56) References Cited

U.S. PATENT DOCUMENTS

| | | | | |
|---|---|---|---|---|
| 2,671,004 | A * | 3/1954 | Chadwick et al. | 312/350 |
| 3,012,554 | A * | 12/1961 | Hirsch | 126/338 |
| 3,043,290 | A * | 7/1962 | Smith | 126/337 A |
| 2006/0102015 | A1 * | 5/2006 | Baker et al. | 99/450 |

* cited by examiner

*Primary Examiner* — Kenneth Rinehart
*Assistant Examiner* — Jason Lau
(74) *Attorney, Agent, or Firm* — James E. Howard; Andre Pallapies

(57) ABSTRACT

An oven rack for an oven that providing additional clearance for an object on the oven rack. The oven rack comprises a generally rectangular shape including a front member, a rear member, and side members extending between the front and rear members. A grid structure is connected to the front, rear and side members and supports objects on the oven rack. Two rear rails are connected to the rear member to help retain objects on the oven rack. The rear rails project rearwardly and upwardly from rear member and define a free space being between the rear rails providing additional clearance for objects placed on the oven rack.

6 Claims, 5 Drawing Sheets

COOKING APPLIANCE WITH AN OVEN RACK

FIELD OF THE INVENTION

The invention relates generally to cooking appliances, and more particularly to an oven rack for a cooking appliance.

BACKGROUND OF THE INVENTION

Foodstuffs may be baked or broiled inside the heated space of an oven, stove, or range (hereinafter "ovens" for simplicity) via placement of the foodstuffs on a cooking vessel such as, for example, on a broiling tray. The oven may include an oven rack to support objects within the oven. Some ovens include oven racks having a raised rear portion help prevent object on the oven rack from falling off the back of the rack when being removed. These raised rear portions generally extend vertically from the oven rack and prevent object from extending beyond the rack and restrict the size of the objects that may be placed on the rack.

SUMMARY OF THE INVENTION

The present invention provides an oven rack for an oven that provides additional clearance for an object on the oven rack. The oven rack comprises a generally rectangular shape including a front member, a rear member, and side members extending between the front and rear members. A grid structure is connected to the front, rear and side members and supports objects on the oven rack. Two rear rails are connected to the rear member to help retain objects on the oven rack. The rear rails project rearwardly and upwardly from rear member and define a free space being between the rear rails providing additional clearance for objects placed on the oven rack.

Each rear rail includes an inner support rail and an outer support rail connected to the rear rail and a cross rail extending between the inner and outer support rails. The rear rails are angled away from the oven rack to provide additional clearance. The rear rails form an angle with a vertical axis extending through the rear member in a vertical direction being substantially transverse to the rear member. The angle between the rear rails and the vertical axis is generally greater than 0 degrees and less than or equal to 45 degrees. In some aspects and in some constructions, the angle between the rear rails and the vertical axis is about 30 degrees.

An object of the present invention having been stated hereinabove, and which is addressed in whole or in part by the present invention, other objects will become evident as the description proceeds when taken in connection with the accompanying drawings as best described hereinbelow.

DETAILED DESCRIPTION OF THE INVENTION

Figure 1:
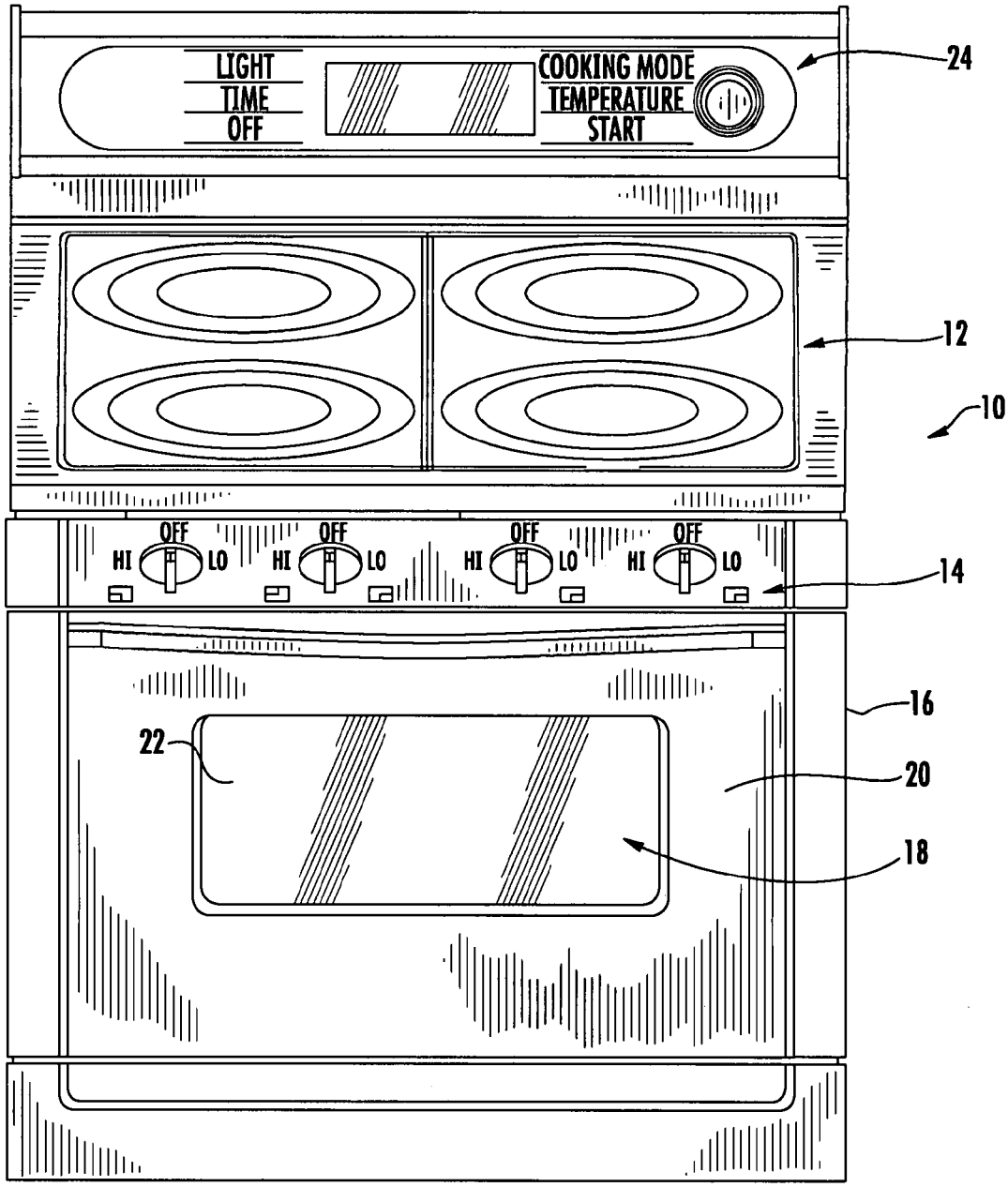
FIG. 1 is a perspective view of an oven having conventional baking elements.
Figure 2:
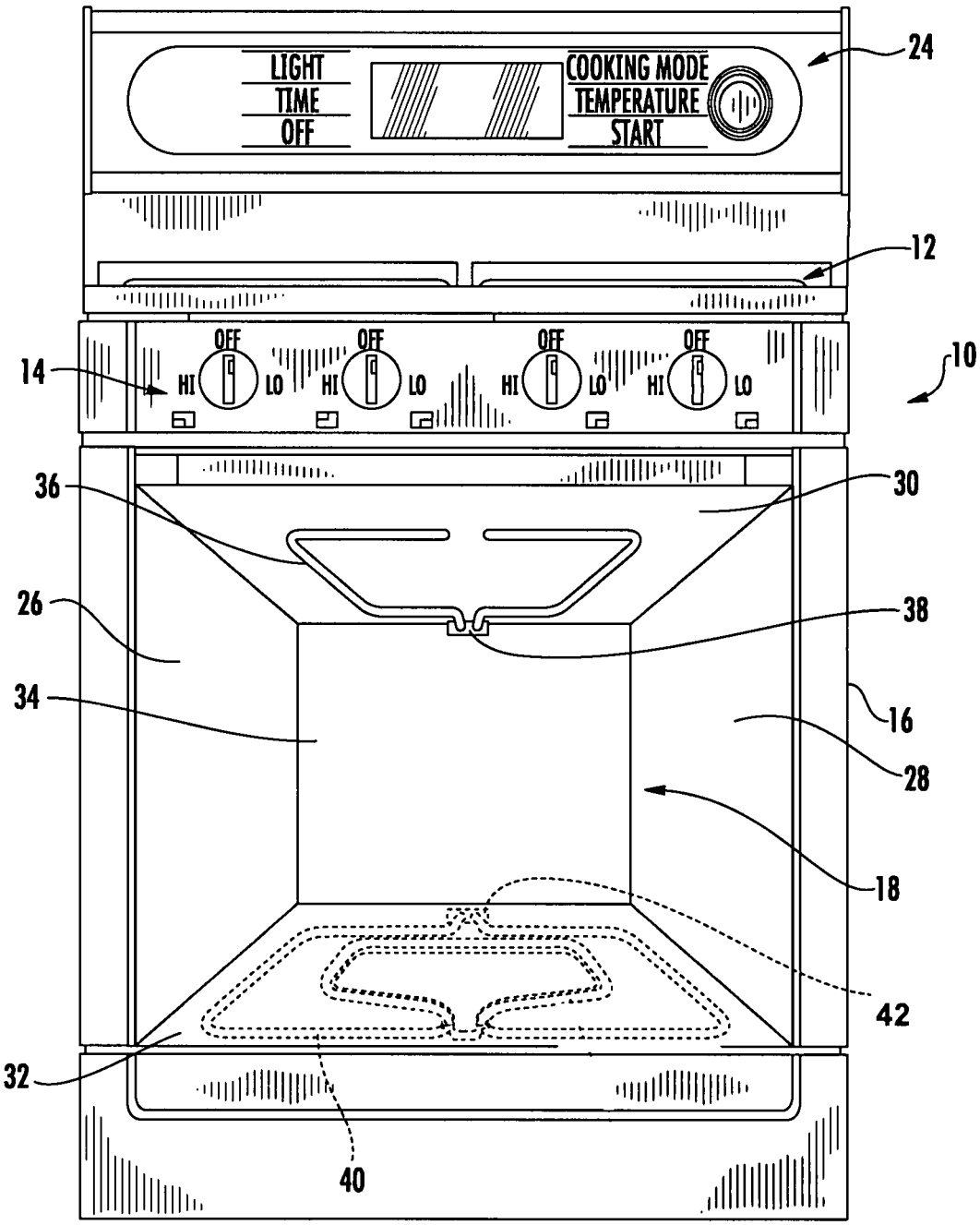
FIG. 2 is a front plan view of the oven of FIG. 1 including a schematic view of one location of the heating element shield of the present invention.

Referring now to FIGS. 1 and 2, an electric oven or range 10 ("oven" is used for ease of reference hereinafter), such as a free standing range as illustrated or a built in oven (not illustrated), includes conventional broiling elements and the broiling element with loops of non-uniform length of the present invention can be installed in such an oven 10 ("oven" is used for ease of reference hereinafter)in lieu of such conventional broiling elements, as will be described in more detail hereinafter. The oven 10 includes a range top 12 and an associated control panel 14 for the burners of the range top 12. The oven 10 includes a frame 16, with an oven cavity 18 in the lower portion thereof below the range top 12 as is conventional when such a range top 12 is included with the oven 10. The oven cavity 18 is closed by an oven door 20, which generally can include a window 22 for the user to view the inside of the oven cavity 18, such as to view food cooking in the oven cavity 18. The operation of the oven cavity 18 is controlled by the user utilizing a second control panel 24. The self-cleaning operation of the oven cavity 18 is controlled by operation of the control panel 24.

With reference to FIG. 2, the oven cavity 18 generally has side walls 26 and 28, a top wall 30, a bottom wall 32, and a back wall 34. In the immediate vicinity of the top wall 30, an interior or broil heating element (resistance coil) 36 can be disposed for grilling or broiling. The broil heating element 36 can be of any heating element known in the art and is in contact with a plug 38, for example, or another type of connecting element through its electrical terminals. Below the bottom wall 32 of the oven cavity 18, an external or bake heating element 40 is disposed and is in contact with another plug 42, for example, or another type of connecting element through its electrical terminals.

Figure 3:
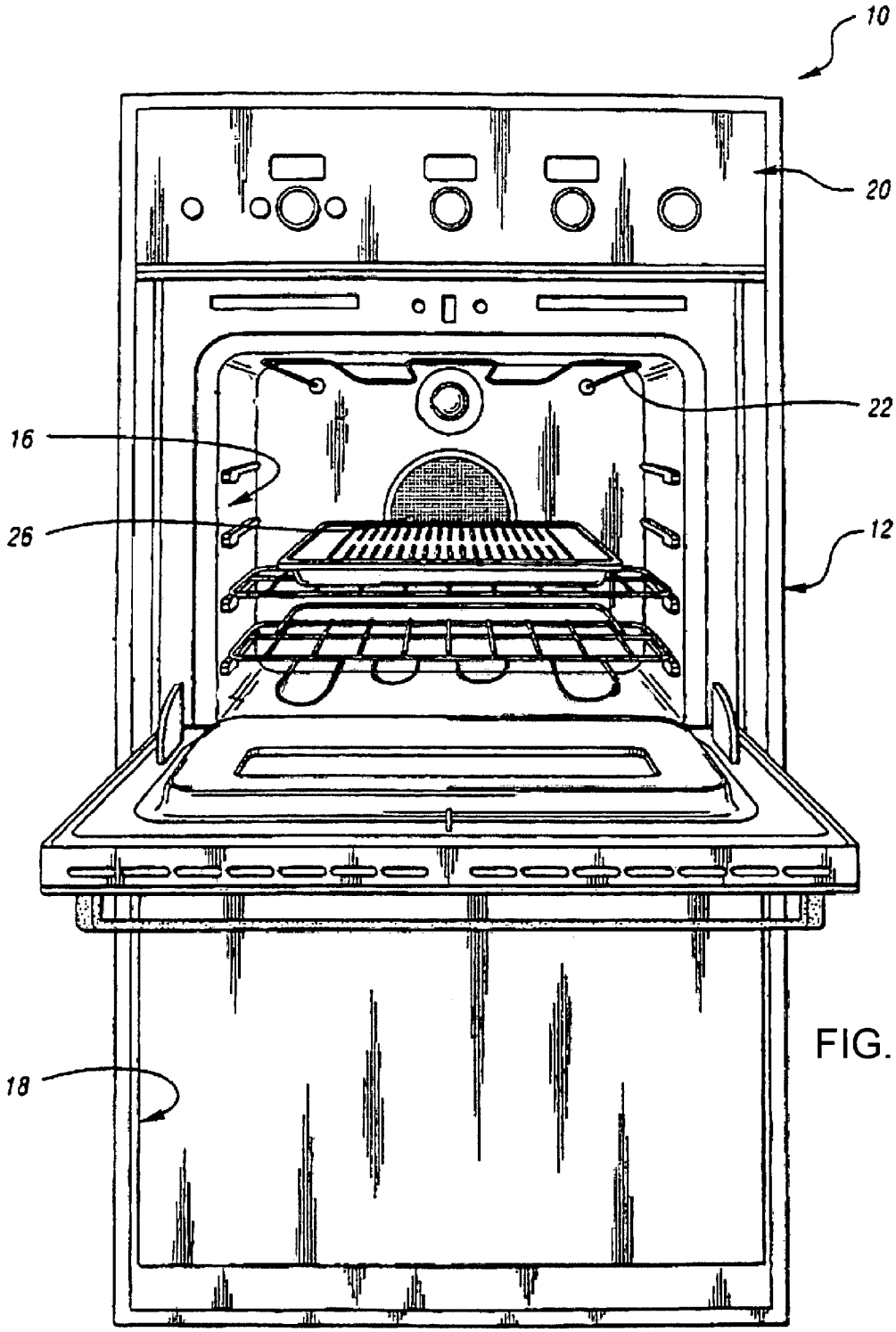
FIG. 3 is an enlarged front perspective view of the oven described with respect to FIG. 1.
Figure 4:
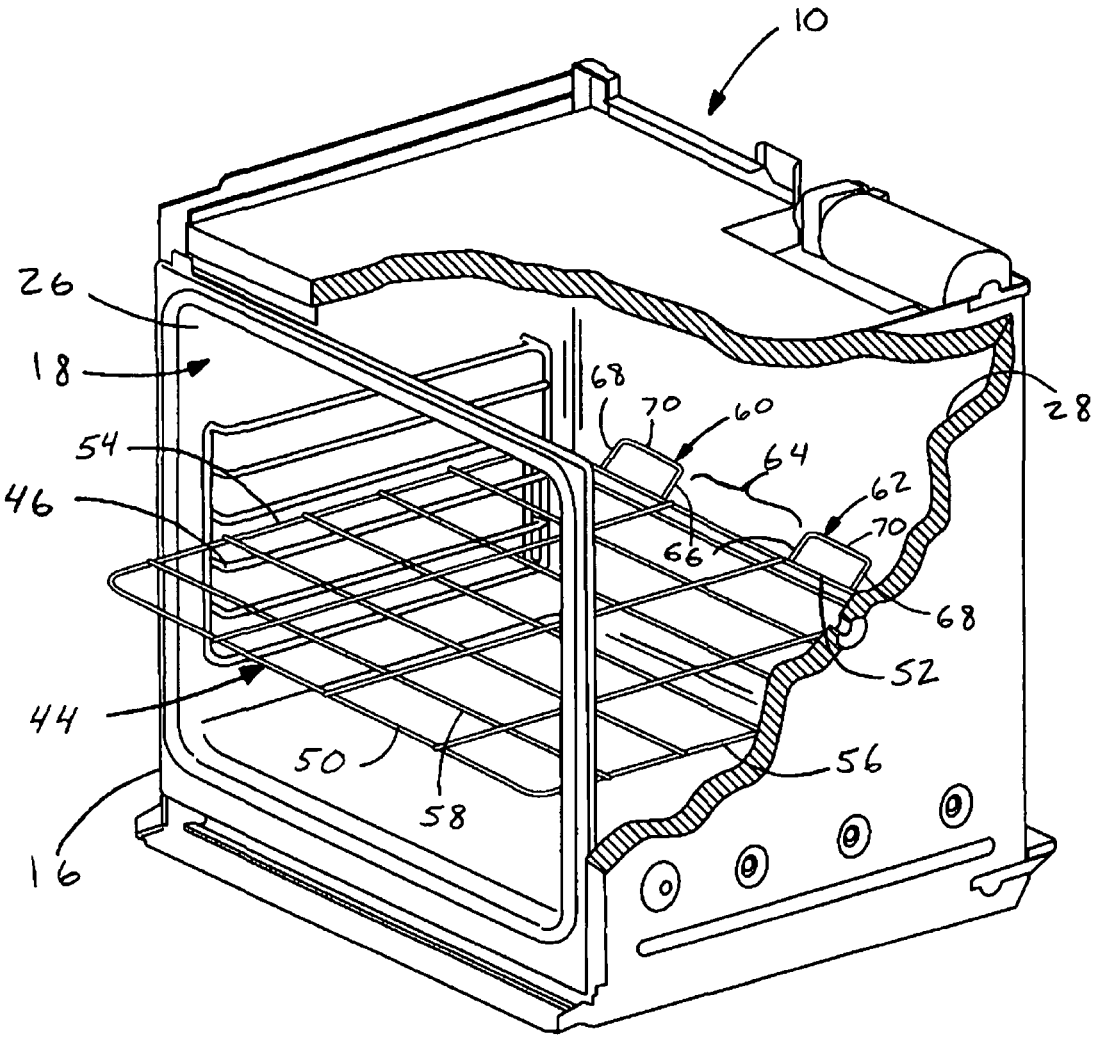
FIG. 4 is an enlarged sectional front perspective view of the oven described with respect to FIG. 1 and showing details of the one embodiment of the oven rack of the present invention.

Reference is now had to FIG. 3, which is an enlarged front perspective view of the cooking appliance described with respect to FIG. 1, and FIG. 4, which an enlarged sectional front perspective view of the cooking appliance described with respect to FIG. 1 and showing details of the one embodiment of the oven rack of the present invention. It can be seen that the oven 10 includes an oven rack 44 and further details thereof will now be provided.

FIG. 4 illustrates a partial cut-away portion of the oven 10 showing the oven cavity 18 with at least one elongated side bracket 46 extending along each side wall 26, 28 of the oven cavity 18. The oven rack 44 is supported on the side brackets 46 and is movable with respect to the oven frame 16 to facilitate the loading and unloading of objects in the oven 10. The oven 10 may include multiple side brackets 46 on each side wall 26, 28 to allow the oven rack 44 to be supported at various heights within the oven cavity 18.

The oven rack 44 forms a substantially rectangular shape including a front member 50, a rear member 52, and side members 54, 56 extending between the front member 50 and the rear member 52. A grid structure 58 is connected to the front, rear, and side members 50, 52, 54, 56 for supporting objects on the oven rack 44 within the oven 10. The oven rack 44 may be formed from a rigid metal wire-type material and the grid structure 58 may be connected to the front, rear, and side members 50, 52, 54, 56 with welded connections.

As shown in FIG. 4, two rear rails 60, 62 are connected to the rear member 52 to help retain objects on the oven rack 44 when the rack 44 is being moved. The rear rails 60, 62 project away from rear member 52 in a rearwardly and upwardly direction to help provide clearance for objects on the oven rack 44. The rear rails 60, 62 are spaced apart from one another forming a free space 64 between the rear rails 60, 62 that provides additional clearance for objects placed on the oven rack 44.

In the illustrated construction, each rear rail 60, 62 includes inner and outer bars 66, 68 connected to the rear member 52, with the outer bar 68 being positioned closer to the respective side member 54, 56. A cross bar 70 extends between the inner and outer bars 66, 68 in a direction substantially parallel to the rear member 52. The inner and outer bars 66, 68 and the cross bar 70 extend around the perimeter of each rear rail 60, 62 and provide an open central region within each rear rail 60, 62. In an alternate construction, the rear rails may be formed from a solid material, such as a rigid metal plate connected to the rear member 52.

Figure 5:
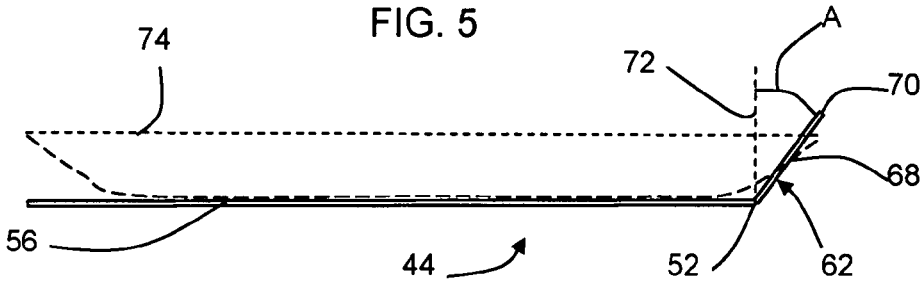
FIG. 5 is a side view of the oven rack shown in FIG. 4.

FIG. 5 illustrates a side view of the oven rack 44 with a vertical axis 72 extending through the rear member 52 in a direction substantially transverse to the frame 48. The rear rail 62 extends away from the rear member 52 in a rearwardly and upwardly direction and forms an angle A with the vertical axis 72. The angle A between the vertical axis and the rear rail 62 is preferably greater than 0 degrees to provide some additional clearance and less than or equal to 45 degrees to maintain a substantial enough vertical component to retain objects on the oven rack 44. In the illustrated construction, the angle A between the vertical axis 72 and the rear rail 62 is about 30 degrees.

Figure 6:
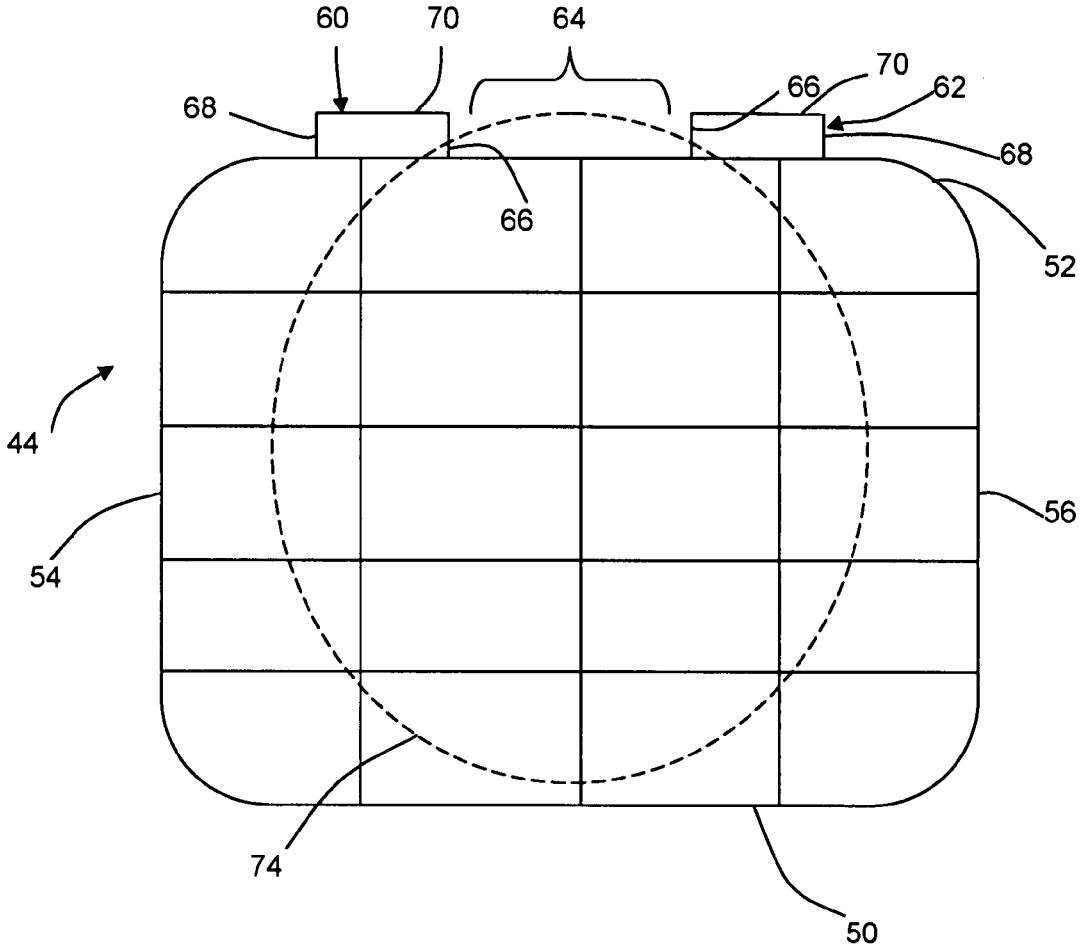
FIG. 6 is a top view of the oven rack shown in FIG. 4.

FIG. 6 is top view of the oven rack 44 with the rear rails 60, 62. The angled position of the rear rails 60, 62 and the free space 64 between the rear rails 60, 62 provide additional clearance to accommodate large objects placed on the rack 44. For example, FIG. 6 illustrates a circular pizza pan 74 placed on the oven rack 44. The angled position of the of the rear rails 60, 62 allows the pizza pan 74 to at least partially overlap the rear member 52 and extend beyond the rear member 52. Also, the free space 64 between the rear rails 60, 62 allows a portion of the circular pizza pan 74 to extend between the rear rails 60, 62. Depending on the distance between the rear rails 60, 62, the pizza pan 74 may even extend beyond the rear rails 60, 62 in a rearwardly direction. However, the rear rails 60, 62 still extend at least partially upwardly from the rear member 52 and help retain the pizza pan 74 on the oven rack 44. When the oven rack 44 is moved forwardly out of the oven cavity 18, the rear rails 60, 62 help prevent the pizza pan 74 from falling off the back of the oven rack 44. Alternatively, a pizza may be placed directly on the oven rack 44 and still have the additional clearance to overhang the rear member 52 between the rear rails 60, 62.

What is claimed is:

1. An oven rack comprising:

a front member, a rear member, and side members extending between the front and rear members;

a grid structure for supporting objects on the oven rack and being connected to the front, rear and side members, the rear member being connected at a left rear corner with a side member and being connected at a right rear corner with another side member; and two rear rails projecting rearwardly and upwardly from the rear member and a free space being defined between the rear rails providing additional clearance for objects supported on the oven rack, each rear rail being formed of an inner bar connected to the rear member of the grid structure, an outer bar connected to the rear member of the grid structure, and a cross bar extending to and between the inner and outer bars and extending substantially parallel to the rear member of the grid structure, the free space defined between the rear rails spanning a center of the rear member of the grid structure and extending rearward of a rearmost member of the grid structure for supporting the objects on the oven rack, a respective one of the rear rails being more proximate to the left rear corner of the grid structure than the other rear rail and spaced inwardly toward the center of the rear member of the grid structure from the left rear corner and the other rear rail being more proximate to the right rear corner of the grid structure than the one rear rail and spaced inwardly toward the center of the rear member of the grid structure from the right rear corner, and the cross bars of the two rear rails being rearward of the rearmost member of the grid structure for supporting the objects on the oven rack.

2. The oven rack of claim 1, wherein a vertical axis extends through the rear member in a vertical direction being substantially transverse to the rear member, the rear rails being positioned at an angle with respect to the vertical axis being greater than 0 degrees and less than or equal to 45 degrees.

3. The oven rack of claim 2, wherein the angle between the rear rails and the vertical axis is about 30 degrees.

4. The oven rack of claim 1, wherein each rear rail extends over less than half the length of the rear member.

5. The oven rack of claim 1, wherein the length of each rear rail is less than the distance of the free space between the rear rails.

6. The oven rack of claim 1, wherein the oven rack is operable to be movably supported on side wall support rails of an oven that has a first pair of side wall support rails cooperating to support the oven rack at a lower horizontal level with a first rail of the first pair projecting inwardly from a first side wall of the oven and a second rail of the first pair projecting inwardly from an opposite, second side wall of the oven in opposed relation to the first side wall of the oven and that has a second pair of side wall support rails cooperating to support one of the oven rack and a second oven rack at a higher horizontal level with a first rail of the second pair projecting inwardly from the first side wall of the oven and a second rail of the second pair projecting inwardly from the opposite, second side wall of the oven, and the two rear rails are spaced inwardly from the respective right and left rear corners of the grid structure to clear the side wall support rails of the second pair of side wall support rails that cooperate to support the second oven rack at the higher horizontal level during a movement of the oven rack outwardly of the oven or inwardly of the oven while the oven rack is supported on the first pair of side wall support rails that cooperate to support the oven rack at the lower horizontal level.

* * * * *